US009151247B2

(12) United States Patent
Chen et al.

(10) Patent No.: US 9,151,247 B2
(45) Date of Patent: Oct. 6, 2015

(54) PLUNGER LIFTING MECHANISM OF A ROTARY-VALVE GAS CARBURETOR

(71) Applicants: Qi An Chen, Rui An (CN); Xingyao Zhang, Rui An (CN)

(72) Inventors: Qi An Chen, Rui An (CN); Xingyao Zhang, Rui An (CN)

(73) Assignee: Qi An Chen, Rui An, Zhejiang (CN)

( * ) Notice: Subject to any disclaimer, the term of this patent is extended or adjusted under 35 U.S.C. 154(b) by 173 days.

(21) Appl. No.: 14/070,832

(22) Filed: Nov. 4, 2013

(65) Prior Publication Data

US 2014/0264964 A1 Sep. 18, 2014

(30) Foreign Application Priority Data

Mar. 14, 2013 (CN) ..... 2013 2 0116547 U

(51) Int. Cl.
*F02M 9/08* (2006.01)
*B01F 3/04* (2006.01)
*F02M 9/02* (2006.01)

(52) U.S. Cl.
CPC .. *F02M 9/02* (2013.01); *F02M 9/08* (2013.01)

(58) Field of Classification Search
CPC ..... F02M 9/02; F02M 9/08; B01F 3/04; B01F 3/04099
USPC ..... 261/38, 42, 50.1, 64.1, DIG. 61, DIG. 62
See application file for complete search history.

(56) References Cited

U.S. PATENT DOCUMENTS 2,057,552 A * 10/1936 Bissell ..... 261/69.1

* cited by examiner

*Primary Examiner* — Robert A Hopkins
(74) *Attorney, Agent, or Firm* — Shimokaji & Associates P.C.

(57) ABSTRACT

A plunger lifting mechanism of a rotary-valve gas carburetor includes a carburetor body, a cam, a plunger, a torsion spring, a fixed plate, a throttle wire bracket, a main measuring needle, a sleeve and a main jet pipe. The plunger is rotatablely mounted in the carburetor body, which passes through the cam, the torsion spring and fixed plate in turn and then extends out of the carburetor body, and a top of the plunger is connected with the throttle wire bracket and then fixedly connected with the sleeve; the fixed plate is fixedly connected with the carburetor body; one end of the torsion spring is elastically suppressed by the fixed plate, and the other end of the torsion spring is elastically suppressed by protrusions on side walls of the plunger. The configuration can ensure sufficient flexibility of its plunger and improve the reliability of the carburetor.

3 Claims, 4 Drawing Sheets

PLUNGER LIFTING MECHANISM OF A ROTARY-VALVE GAS CARBURETOR

This application claims the benefit of Chinese Patent Application No. 201320116547.9, filed on Mar. 14, 2013, the entire content of which is hereby incorporated by reference in this application.

FIELD OF THE INVENTION

The present invention relates to a carburetor, and more particularly to a plunger lifting mechanism of a rotary valve plunger type carburetor.

BACKGROUND OF THE INVENTION

Carburetors are equipments that mix the proportional fuel and air in a vacuum condition generated by an engine. The carburetor acted as an exact measuring apparatus plays an important role in the engine and thus is called as a "heart" of the engine. The carburetor apparatus includes a starting device, an idling device, a moderate load device, a full load device and an accelerator. According to different working status demands of the engine, the carburetor can proportion the corresponding concentration and output the mixed gas with corresponding quantity. To uniform the mixed gas, the carburetor can further atomize the fuel to support the normal operation of the apparatus.

While a rotary valve plunger type carburetor is one type of carburetors that changes the amount of fuel outputted by lifting or lowering a plunger. Commonly, a conventional plunger lifting mechanism of a carburetor includes rollers, plunger, cam and main measuring needle and the like. This plunger lifting mechanism is configured at outer top of the carburetor body, and the spiral surface is formed on the throttle wire bracket, and the lifting and lowering movement is driven by engaging the spiral surface with steel balls of the fixed plate. However, for this structure, scraps are easy to be accumulated at the spiral surface, to reduce the agility of the plunger. Furthermore, the movement of the plunger along the spiral surface has only supporting point, which may generate deflected force of the plunger, and bring problems such as the plunger is blocked and the plunger is not flexible.

SUMMARY OF THE INVENTION

Accordingly, an object of the present invention is to provide a plunger lifting mechanism of a rotary-valve gas carburetor to ensure sufficient flexibility of its plunger.

To achieve the above-mentioned object, the present invention provides a plunger lifting mechanism of a rotary-valve gas carburetor which includes a carburetor body, a cam, a plunger, a torsion spring, a fixed plate, a throttle wire bracket, a main measuring needle, a sleeve and a main jet pipe.

The cam is connected in the carburetor body, and a through hole is defined at a center of the cam to allow the plunger to pass, the cam has a top surface that is a spiral surface including two identical and symmetrical spiral sub-surfaces.

The plunger is rotatablely mounted in the carburetor body, which passes through the cam, the torsion spring and fixed plate in turn and then extends out of the carburetor body, and a top of the plunger is connected with the throttle wire bracket and then fixedly connected with the sleeve; the fixed plate is fixedly connected with the carburetor body; one end of the torsion spring is elastically suppressed by the fixed plate, and the other end of the torsion spring is elastically suppressed by protrusions on side walls of the plunger.

The plunger is provided with two pins on each of which a roller is mounted, and the two rollers are contacting with the two spiral sub-surfaces of the cam; the main measuring needle sleeved with a spring is fixed in the plunger, which is cooperated with the main jet pipe to constitute an injector.

Preferably, a connection manner between the cam and the carburetor body is that, the carburetor body is provided with two retaining grooves, and a bottom of the cam is provided with two retaining projections to engage with the retaining grooves, the retaining projections are inserted into the retaining grooves thereby connecting the cam with the carburetor body.

Preferably, a connection manner between the top of the plunger and the throttle wire bracket is that, outer walls of the top of the plunger has a first straight surface and a second straight surface, and the throttle wire bracket has a hole to allow the plunger to pass, inner walls of the hole are cooperated with the outer walls of the top of the plunger, and the plunger and the throttle wire bracket are sleeved by the sleeve.

In comparison with the prior art, the plunger lifting mechanism of a rotary-valve gas carburetor of the present invention is formed within the carburetor body via a cam mechanism, thus dust won't be entered to the spiral surface of the cam, and scraps won't be accumulated on the cam, thereby the flexibility of the plunger is ensured, and finally the reliability of the carburetor is improved.

Furthermore, the present invention improves the cam mechanism, namely modifies the top of the cam as a spiral surface having two identical and symmetrical spiral sub-surfaces, and adds two sets of pin and roller as so to uniform and balance the force of both sides of the plunger during lifting and lowering movement, and in turns improve the flexibility of the plunger.

REFERENCE NUMERALS

Figure 1:
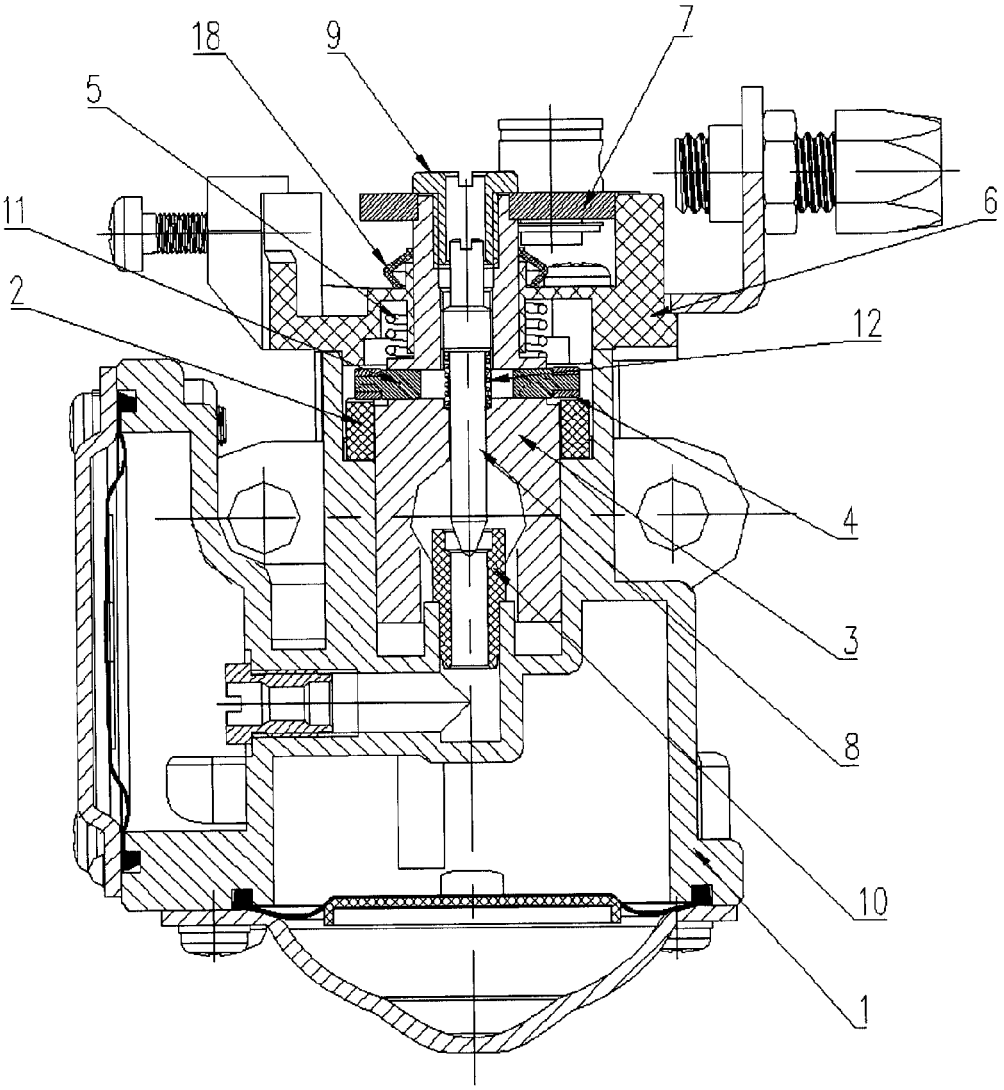
FIG. 1 is a cross-sectional view of a plunger lifting mechanism of a carburetor according to one embodiment of the present invention.

Carburetor body 1; cam 2; plunger 3; roller 4; torsion spring 5; fixed plate 6; throttle wire bracket 7; main measuring needle 8; sleeve 9; main jet pipe 10; pin 11; spring 12; retaining groove 13; retaining protrusion 14; first straight surface 15; second straight surface 16; hole 17; gasket 18; spiral surface 19.

DETAILED DESCRIPTION OF ILLUSTRATED EMBODIMENTS

In order to expatiate the technical solution to achieve the objects of the present invention further, an explanatory embodiment of the present invention and its features and advantages will now be described with reference to the Figures, wherein like reference numerals designate similar parts throughout the various views.

Figure 2:
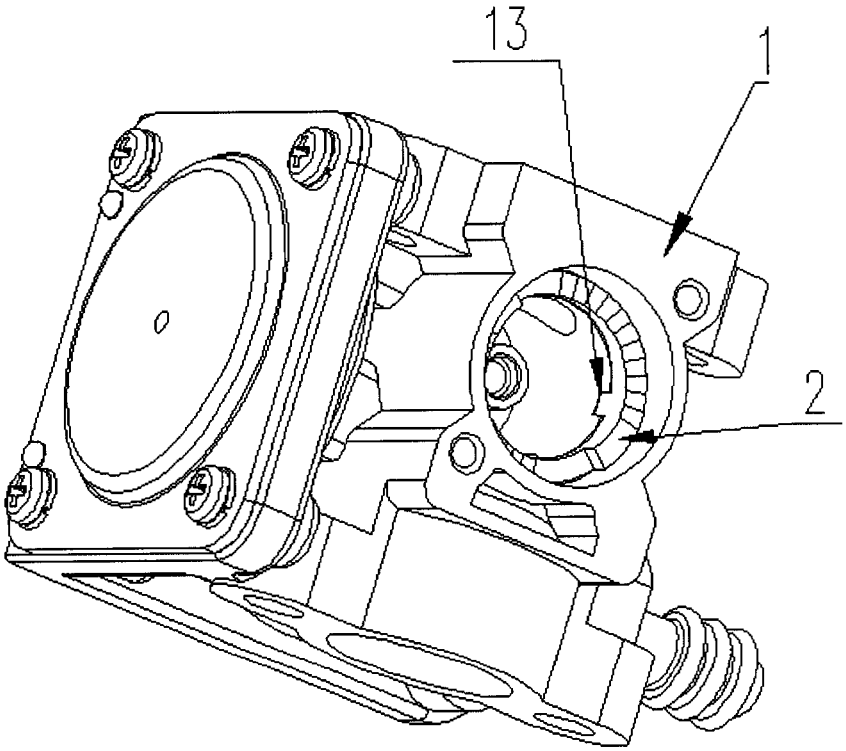
FIG. 2 is a perspective view of the carburetor body.
Figure 3:
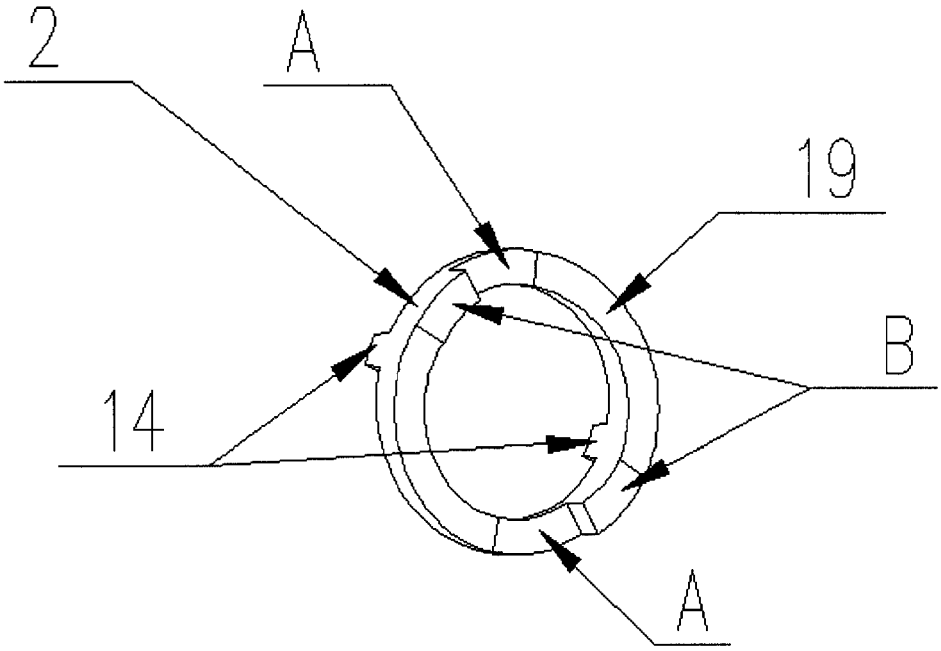
FIG. 3 is a perspective view of the cam.
Figure 4:
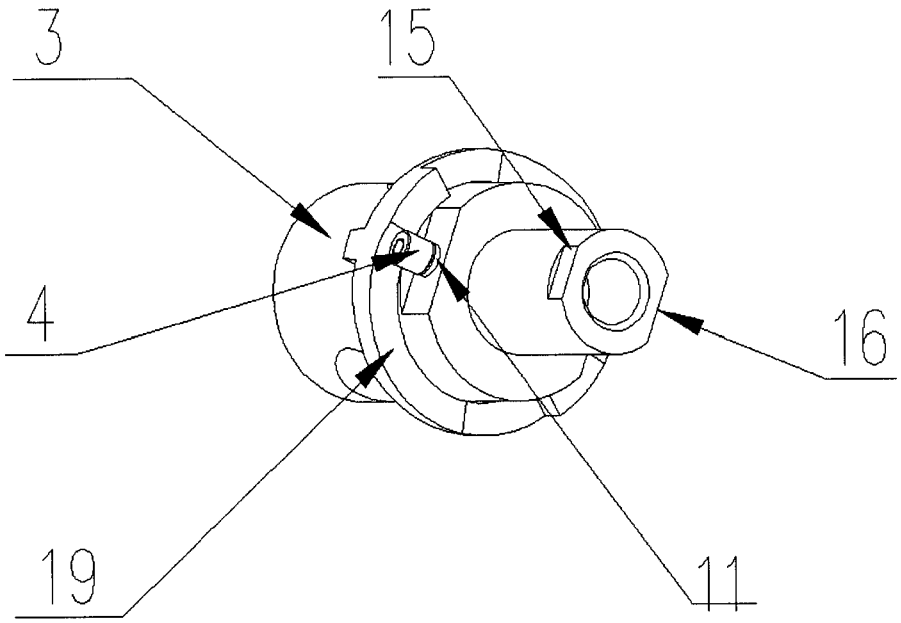
FIG. 4 is a perspective view of the connection position of the plunger and the cam.
Figure 5:
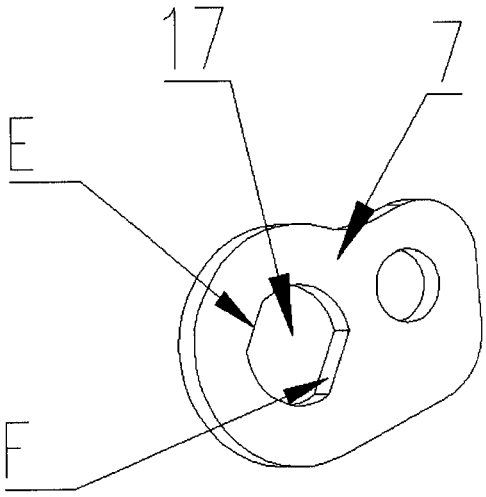
FIG. 5 is a perspective view of the throttle wire bracket.

Referring to FIGS. 1-5, a plunger lifting mechanism of a carburetor of the present invention includes a carburetor body 1, a cam 2, a plunger 3, a roller 4, a torsion spring 5, a fixed plate 6, a throttle wire bracket 7, a main measuring needle 8, a sleeve 9, a main jet pipe 10, a pin 11 and a spring 12. Concretely, the cam 2 is connected in the carburetor body 1, and the center of the cam 2 is formed a through hole to allow the plunger 3 to pass, the top surface of the cam 2 is a spiral surface 19 which has two identical and symmetrical spiral sub-surfaces. Each of spiral sub-surface has a transition from a lower surface A to a higher surface B, specifically, the lower surface A of the first spiral sub-surface is adjacent to the higher surface B of the second spiral sub-surface, and the higher surface B of the first spiral sub-surface is adjacent to the lower surface A of the second spiral sub-surface.

The plunger 3 is rotatablely mounted in the carburetor body 1, and it passes through the cam 2, the torsion spring 5 and the fixed plate 6 in turn and then extends out of the carburetor body 1. Specifically, the top of the plunger 3 is connected with the throttle wire bracket 7 and then the both is fixedly connected with the sleeve 9, so that the plunger 3 will be rotated as the throttle wire bracket 7 is rotated. The plunger 3 has two pins 11 formed thereon, and each of the pins 11 is provided with a roller 4 to contact the spiral sub-surfaces of the cam 2. Therefore, the roller 4 is driven by the spiral surface 19 of the cam 2, which cause the plunger 3 is lifted or lowered to control the mixed proportion, thereby supplying the needed mixed gas for the engine. Additionally, the fixed plate 6 is fixedly connected with the carburetor body 1, and one end of the torsion spring 5 is elastically suppressed by the fixed plate 6, the other end is elastically suppressed by protrusions on side walls of the plunger 3. The main measuring needle 8 is sleeved with a spring 12 and then fixed in the plunger 3, which is movably connected with the main jet pipe 10 to form an injector to control the fuel flow.

The lifting mechanism of the plunger 3 is explained as following. The plunger 3 is provided with two coaxial holes arranged for mounting the pins 11, and each pin 11 is mounted with the roller 4, thereby the plunger 3 can be rotated and moved up and down by cooperated the roller 4 with the spiral surface 19 of the cam 2. In the present embodiment, the connection manner between the cam 2 and the carburetor body 1 is that, the carburetor body 1 is provided with two retaining grooves 13, and a bottom of the cam 2 is provided with two retaining projections 14 to engage with the retaining grooves 13. When the retaining projections 14 are inserted into the retaining grooves 13, the cam 2 is connected with the carburetor body 1. Other connection manners also can be adopted, if only the connection between the cam 2 and the carburetor body 1 is ensured.

While the connection manner between the top of the plunger 3 and the throttle wire bracket 7 is described as following. Outer walls of the top of the plunger 3 has a first straight surface 15 and a second straight surface 16, and the throttle wire bracket 7 has a hole 17 to allow the plunger 3 to pass, the inner walls of the hole 17 are cooperated with the outer walls of the top of the plunger 3, that is, surface E and surface F of the hole 17 are cooperated with the first straight surface 15 and the second straight surface 16 respectively, so as to ensure that the plunger 3 can be rotated as the throttle wire bracket 7 is rotated. Other connection manners also can be adopted, if only the movement of the cam 2 and the carburetor body 1 is ensured.

Preferably, a gasket 18 is sleeved on the plunger 3, which is positioned at a portion of the plunger 3 where is extended to the fixed plate 6, thereby keeping tightness of the contacting position between the plunger 3 and the fixed plate 6.

The principle of the plunger lifting mechanism of a carburetor of the present invention is described as following.

When the throttle wire bracket 7 is pulled, the throttle wire bracket 7 and the plunger 3 are rotated together, and then the rollers 4 on the plunger 3 are rolled along the spiral surface 19 of the cam 2. Due to the spiral surface 19 is configured from low surface to high surface, thus the plunger 3 is lifted. As a result, the main measuring needle 8 mounted in the plunger 3 is lifted as well, by now, a gap between the main measuring needle 8 and the main jet pipe 10 is increased, which thus increases the fuel flow supplying to the engine, to meet the fuel demand for the engine.

Contrarily, if the throttle wire bracket 7 is released, the roller 4 of the plunger 3 will roll along the spiral surface 19 of the cam 2 from a high point to a low point, under the reaction of the torsion spring 5. Meanwhile, the main measuring needle 8 moves along the hole of the main jet pipe 10, as a result the gap between the main measuring needle 8 and the main jet pipe 10 is reduced, which therefore reduce the fuel flow supplying to the engine, to meet the less fuel demand when the engine is under idling The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plunger lifting mechanism of a rotary-valve gas carburetor comprising a carburetor body (1), a cam (2), a plunger (3), a torsion spring (5), a fixed plate (6), a throttle wire bracket (7), a main measuring needle (8), a sleeve (9) and a main jet pipe (10);

wherein the cam (2) is connected in the carburetor body (1), and a through hole is defined at a center of the cam (2) to allow the plunger (3) to pass, the cam (2) has a top surface that is a spiral surface including two identical and symmetrical spiral sub-surfaces;

the plunger (3) is rotatablely mounted in the carburetor body (1), which passes through the cam (2), the torsion spring (5) and fixed plate (6) in turn and then extends out of the carburetor body (1), and a top of the plunger (3) is connected with the throttle wire bracket (7) and then fixedly connected with the sleeve (9); the fixed plate (6) is fixedly connected with the carburetor body (1); one end of the torsion spring (5) is elastically suppressed by the fixed plate (6), and the other end of the torsion spring (5) is elastically suppressed by protrusions on side walls of the plunger (3);

the plunger (3) is provided with two pins on each of which a roller (4) is mounted, and the two rollers (4) are contacting with the two spiral sub-surfaces of the cam (2); the main measuring needle (8) sleeved with a spring (12) is fixed in the plunger (3), which is cooperated with the main jet pipe (10) to constitute an injector.

2. The plunger lifting mechanism of a rotary-valve gas carburetor as claimed in claim 1, wherein a connection manner between the cam (2) and the carburetor body (1) is that, the carburetor body (1) is provided with two retaining grooves (13), and a bottom of the cam (2) is provided with two retaining projections (14) to engage with the retaining grooves (13), the retaining projections (14) are inserted into the retaining grooves (13) thereby connecting the cam (2) with the carburetor body (1).

3. The plunger lifting mechanism of a rotary-valve gas carburetor as claimed in claim 1, wherein a connection manner between the top of the plunger (3) and the throttle wire bracket (7) is that, outer walls of the top of the plunger (3) has a first straight surface (15) and a second straight surface (16), and the throttle wire bracket (7) has a hole (17) to allow the plunger (3) to pass, inner walls of the hole (17) are cooperated with the outer walls of the top of the plunger (3), and the plunger (3) and the throttle wire bracket (7) are sleeved by the sleeve (9).

* * * * *